US007254908B2

(12) United States Patent
Ungari

(10) Patent No.: US 7,254,908 B2
(45) Date of Patent: Aug. 14, 2007

(54) ARTICLE OF FOOTWEAR WITH VARIABLE SUPPORT STRUCTURE

(75) Inventor: Joseph L. Ungari, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 231 days.

(21) Appl. No.: 10/774,704

(22) Filed: Feb. 6, 2004

(65) Prior Publication Data

US 2005/0172515 A1 Aug. 11, 2005

(51) Int. Cl.
*A43B 23/00* (2006.01)

(52) U.S. Cl. ..... 36/29; 36/45

(58) Field of Classification Search ..... 36/29, 36/137

See application file for complete search history.

(56) References Cited

U.S. PATENT DOCUMENTS

| | | | | |
|---|---|---|---|---|
| 4,183,156 | A | 1/1980 | Rudy | |
| 4,219,945 | A | 9/1980 | Rudy | |
| 4,255,877 | A | 3/1981 | Bowerman | |
| 4,287,675 | A | 9/1981 | Norton et al. | |
| 4,288,929 | A | 9/1981 | Norton et al. | |
| 4,354,318 | A | 10/1982 | Frederick et al. | |
| 4,364,188 | A | 12/1982 | Turner et al. | |
| 4,364,189 | A | 12/1982 | Bates | |
| 4,772,407 | A | 9/1988 | Carlson | |
| 4,923,057 | A | 5/1990 | Carlson et al. | |
| 5,230,249 | A * | 7/1993 | Sasaki et al. | 36/29 |
| 5,247,742 | A | 9/1993 | Kilgore et al. | |
| 5,294,360 | A | 3/1994 | Carlson et al. | |
| 5,306,438 | A | 4/1994 | Carlson et al. | |
| 5,343,638 | A * | 9/1994 | Legassie et al. | 36/29 |
| 5,382,373 | A | 1/1995 | Carlson et al. | |
| 5,547,049 | A | 8/1996 | Weiss et al. | |
| 5,693,004 | A | 12/1997 | Carlson et al. | |
| 5,711,746 | A | 1/1998 | Carlson | |
| 5,784,807 | A * | 7/1998 | Pagel | 36/93 |
| 5,806,208 | A * | 9/1998 | French | 36/28 |
| 5,813,142 | A * | 9/1998 | Demon | 36/29 |
| 5,816,372 | A | 10/1998 | Carlson et al. | |
| 5,896,683 | A | 4/1999 | Foxen et al. | |
| 5,947,238 | A | 9/1999 | Jolly et al. | |
| 6,014,823 | A * | 1/2000 | Lakic | 36/93 |
| 6,158,910 | A | 12/2000 | Jolly et al. | |
| 6,394,239 | B1 | 5/2002 | Carlson | |
| 6,557,274 | B2 * | 5/2003 | Litchfield et al. | 36/88 |
| 6,865,825 | B2 * | 3/2005 | Bailey, Sr. et al. | 36/29 |
| 2003/0212356 | A1 * | 11/2003 | Scorvo | 602/20 |
| 2004/0002665 | A1 * | 1/2004 | Parihar et al. | 600/587 |

* cited by examiner

*Primary Examiner*—Marie Patterson
(74) *Attorney, Agent, or Firm*—Banner & Witcoff, Ltd.

(57) ABSTRACT

An article of footwear having a variable support structure includes a sole structure and an upper secured to the sole structure. At least one reservoir of magneto-rheological fluid is positioned in at least one of the upper and the sole structure. A magnet assembly is positioned proximate each reservoir, and a magnetic field produced by the magnet assembly transforms the magneto-rheological fluid from a fluid state to a near-solid state.

19 Claims, 2 Drawing Sheets

ARTICLE OF FOOTWEAR WITH VARIABLE SUPPORT STRUCTURE

FIELD OF THE INVENTION

This invention relates generally to an article of footwear, and, in particular, to an article of footwear having a variable support structure.

BACKGROUND OF THE INVENTION

A conventional article of athletic footwear includes two primary elements, an upper and a sole structure. The upper is often formed of leather, synthetic materials, or a combination thereof and comfortably secures the footwear to the foot, while providing ventilation and protection from the elements. The sole structure generally incorporates multiple layers that are conventionally referred to as an insole, a midsole, and an outsole. The insole is a thin cushioning member located within the upper and adjacent the sole of the foot to enhance footwear comfort. The midsole, which is traditionally attached along its peripheral edge to the upper, forms the middle layer of the sole structure and serves a variety of purposes that include controlling potentially harmful foot motions such as pronation, attenuating ground reaction forces, and absorbing energy. In order to achieve these purposes, the midsole may have a variety of configurations. The outsole forms the ground-contacting element of footwear and is usually fashioned from a durable, wear resistant material that includes texturing to improve traction.

The primary element of a conventional midsole is a resilient, polymer foam material that extends throughout the length of the footwear. The properties of the polymer foam material can be varied to regulate the relative stiffness, degree of ground reaction force attenuation, and energy absorption properties of the midsole to accommodate the specific demands of the activity for which the footwear is intended to be used.

Conventional midsoles may also include, for example, stabilizing devices that resist over-pronation and moderators that distribute ground reaction forces. Stability devices are often incorporated into the polymer foam material of the midsoles to control the degree of pronation in the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to stability devices, conventional midsoles may include fluid-filled bladders, as disclosed in U.S. Pat. Nos. 4,183,156 and 4,219,945 to Marion F. Rudy, for example.

To provide increased sidewall stabilizing support, known footwear simply provides additional materials and/or structures to the sidewalls, thereby increasing the complexity of the manufacture of the footwear and its cost. U.S. Pat. No. 5,896,683 to Foxen et al. provides a plurality of finger-like elements that extend from the sole vertically along the upper.

It is an object of the present invention to provide a variable support structure for an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a support structure for an article of footwear that can be transformed from a first inactive state to a second active state on demand.

In accordance with a first aspect, an article of footwear includes a sole structure and an upper secured to the sole structure. At least one reservoir of magneto-rheological fluid is located in at least one of the upper and the sole structure. A magnet assembly is located proximate each reservoir, and a magnetic field produced by the magnet assembly transforms the magneto-rheological fluid from a fluid state to a near-solid state.

In accordance with another aspect, an article of footwear having a variable support structure includes a sole structure and an upper secured to the sole structure. A reservoir of magneto-rheological fluid is located in a sidewall of the upper. A plurality of magnets is located in the sidewall, and a magnetic field produced by the magnets transforms the magneto-rheological fluid from a fluid state to a near-solid state.

In accordance with yet another aspect, an article of footwear having a variable support structure includes a sole structure and an upper secured to the sole structure. A first reservoir of magneto-rheological fluid is formed in a lateral sidewall of the upper and a second reservoir of magneto-rheological fluid is formed in a medial sidewall of the upper. A first plurality of magnets is positioned in the lateral sidewall, and a second plurality of magnets is positioned in the medial sidewall. Each plurality of magnets is configured to produce a magnetic field in a corresponding reservoir and transform the magneto-rheological fluid from a fluid state to a near-solid state.

Substantial advantage is achieved by providing a variable support structure for an article of footwear. In particular, the support structure, which is typically in an inactive state in which the support structure and footwear is in a flexible condition, transforms, upon the application of a force, such as when a user cuts or turns their foot to an active state, in which the support structure has a more rigid configuration, providing additional resistance and support for the user's foot. Consequently, additional support for a user's foot can be provided on demand.

These and additional features and advantages of the invention disclosed here will be further understood from the following detailed disclosure of certain preferred embodiments.

Figure 1:
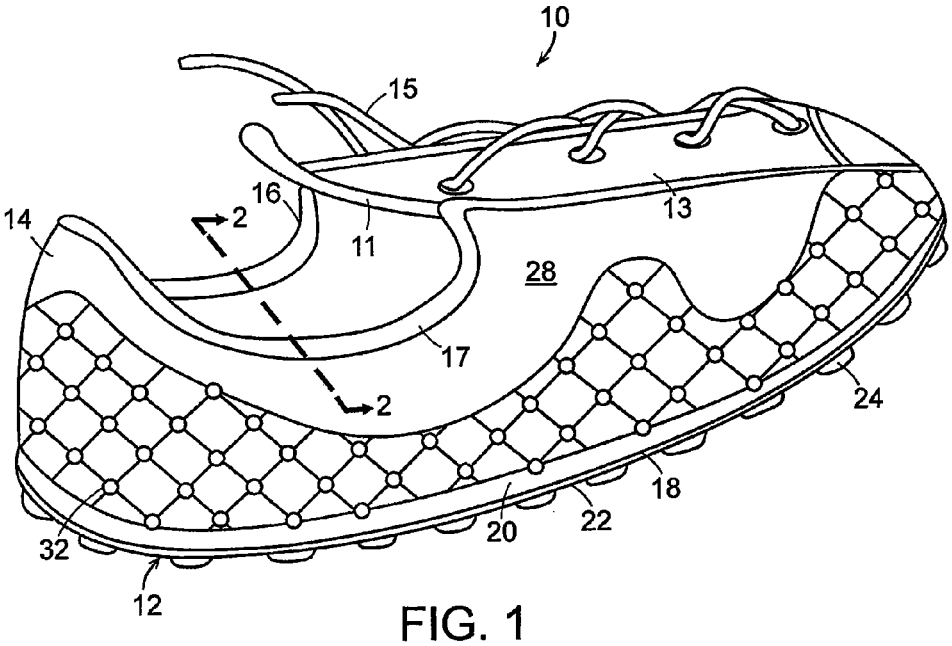
FIG. 1 is a perspective view, shown partially cut away, of an article of footwear with a variable support structure in accordance with the present invention.

The figures referred to above are not drawn necessarily to scale and should be understood to present a representation of the invention, illustrative of the principles involved. Some features of the variable support structure for an article of footwear depicted in the drawings have been enlarged or distorted relative to others to facilitate explanation and understanding. The same reference numbers are used in the drawings for similar or identical components and features shown in various alternative embodiments. Variable support structures for an article of footwear as disclosed herein, would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with the present invention. Although footwear 10 is depicted as a running shoe in FIG. 1, various concepts related to the structure of footwear 10 may be applied to a plurality of other styles of athletic footwear, including basketball shoes, tennis shoes, walking shoes, and cross-training shoes, for example. In addition, the concepts disclosed with respect to footwear 10 may be applied to non-athletic footwear, such as dress shoes, boots, and sandals, for example. The present invention, therefore, applies to a wide variety of footwear styles and is not limited to the precise embodiments disclosed herein.

A preferred embodiment of an article of footwear 10 is shown in FIG. 1. Footwear 10 includes a sole structure 12 and an upper 14 secured to sole structure 12. Upper 14 forms an interior void that comfortably receives a foot and secures the position of the user's foot relative to sole structure 12. The configuration of upper 14, as depicted, is suitable for use during athletic activities that primarily involve running. Accordingly, upper 14 may have a lightweight, breathable construction that includes multiple layers of leather, textile, polymer, and foam elements adhesively bonded and stitched together. For example, upper 14 may have an exterior that includes leather elements and textile elements for resisting abrasion and providing breathability, respectively. The interior of upper 14 may have foam elements for enhancing the comfort of footwear 10, and the interior surface may include a moisture-wicking textile for removing excess moisture from the area immediately surrounding the foot.

Footwear 10 has a medial, or inner, side 16 and a lateral, or outer, side 18. Although sides 16, 18 apply generally to footwear 10, references to sides 16, 18 may also apply specifically to upper 14, sole structure 12, or any other individual component of footwear 10.

In manufacturing footwear 10, the various elements of upper 14 are assembled around a last that imparts the general shape of a foot to the void within upper 14. That is, the various elements are assembled around the last to form a medial side and a lateral side that extend from a forefoot portion to a heel portion of footwear 10; an instep portion that includes a throat 11, tongue 13, and laces 15; and an ankle opening 17 in the heel portion, for example. In addition, at least one of the elements of upper 14, or a separate element such as a strobel sock or lasting board, extends under the last to form a lower surface of upper 14. Sole structure 12, is then permanently secured to the lower surface of upper 14 with an adhesive. Alternately, upper 14 and sole structure 12 may be secured through stitching or other suitable means. An insole (not depicted) is then positioned within upper 14 and adjacent the lower surface of upper 14 to essentially complete the manufacture of footwear 10. In this manner, footwear 10 is manufactured through a substantially conventional process.

Sole structure 12 includes a midsole 20 to which upper 14 is secured, and an outsole 22, which has a tread pattern 24 for added traction. One or more reservoirs 26 are provided in footwear 10. In certain preferred embodiments, a reservoir 26 is formed in a sidewall 28 of upper 14. In the illustrated embodiment, a first reservoir 26 is formed in lateral sidewall 28, and a second reservoir 26 is formed in medial sidewall. Each reservoir 26 contains a magneto-rheological fluid 30. Magneto-rheological fluid 30 comprises magnetic particles suspended in a solution, such as water or oil. In a preferred embodiment, magneto-rheological fluid 30 comprises iron particles suspended in silicon.

A magnet assembly 31 includes a plurality of magnets 32 positioned in sidewall 28 (seen in FIG. 1, where sidewall 28 is shown partially cut away, and in FIG. 2), proximate reservoir 26. In embodiments with a reservoir in both lateral sidewall 28 and medial sidewall 28, a first plurality of magnets 32 is positioned in lateral sidewall 28 while a second plurality of magnets 32 is positioned in medial sidewall 28.

In the illustrated embodiment, magnets 32 are electromagnets. A power source, such as a battery 34 is provided in footwear 10 and provides power to electromagnets 32. Electromagnets 32 are configured to create a magnetic field in reservoir 26 when activated.

In a first, or inactive state, magneto-rheological fluid 30 is in a fluid condition. Upon the application of the magnetic field, the iron particles in magneto-rheological fluid 30 align, thereby transforming magneto-rheological fluid 30 into a near-solid. Transforming magneto-rheological fluid 30 into a near-solid provides additional stiffness, or resistance, in sidewall 28, providing additional support structure of the user's foot. This transformation occurs in a time span of milliseconds, which is sufficiently fast enough to provide support for a user's foot in the portion of footwear 10 in which reservoir 26 is located when the user's foot moves within the article of footwear.

Figure 2:
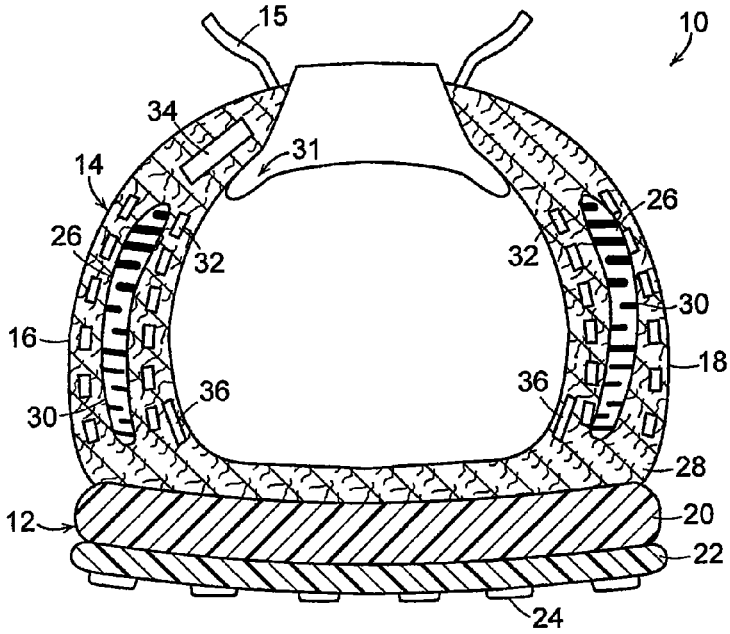
FIG. 2 is a section view, taken along line 2-2 of FIG. 1, of the article of footwear with a variable support structure of FIG. 1.

In certain preferred embodiments, a load cell 36 is provided in footwear 10 to provide detection of a force from a user's foot. When the user's foot moves, it creates a force that is detected by load cell 36, which in turn activates electromagnets 32. In the illustrated embodiment, load cell 36 is positioned proximate an inner surface of sidewall 28. As the user's foot moves within footwear 10, pressure is created on the side of footwear 10 toward which their foot is moving. When a load cell 36 senses pressure greater than a predetermined amount coming from a user's foot moving in that direction, it sends a signal to activate electromagnets 32. As illustrated in FIG. 2, load cell 36 is positioned proximate a lower edge of sidewall 28. It is to be appreciated that load cell 36 can be positioned in any of many locations in footwear 10. For example, load cell 36 could be incorporated in midsole 20 near its outer edge, or in the forefoot portion of footwear 10. Load cell 36 is to be positioned in a location in footwear 10 suitable for detecting a force from a user's foot, and the near-solid magneto-rheological fluid 30 acts against this force. Consequently, the resistance and added support from magneto-rheological fluid 30 in its near-solid state is provided on demand.

When the user's foot moves back toward its initial position, and the load detected by load cell 36 drops below a predetermined level, electromagnets 32 are deactivated, and magneto-rheological fluid 30 transforms back to its inactive fluid state. The process of transforming magneto-rheological fluid 30 back and forth between its fluid and near-solid states happens very rapidly and, therefore, adapts to varying conditions on demand.

Load cell 36 may be formed in known fashion of two layers of a substrate, e.g., a polyester film. A conductive material, e.g., silver, is applied to each layer as well as a layer of pressure-sensitive ink. The load cell acts in known fashion as a resistor in an electrical circuit, with its resistance decreasing upon application of a force. Suitable load sensors are available from, for example, Tekscan of Boston, Mass.

It is to be appreciated that a single reservoir 26 may be formed in upper 14, or, as illustrated in FIG. 2, a plurality of reservoirs 26 may be provided. Further, it is to be appreciated that reservoirs 26 may be provided in any of many portions of upper 14, such as in a heel portion, a midfoot portion, or a forefoot portion of upper 14.

As illustrated in FIG. 2, magnets 32 are positioned on both sides of reservoir 26. It is to be appreciated that in certain preferred embodiments, magnets 32 may be placed on a single side of reservoir 26.

Figure 3:
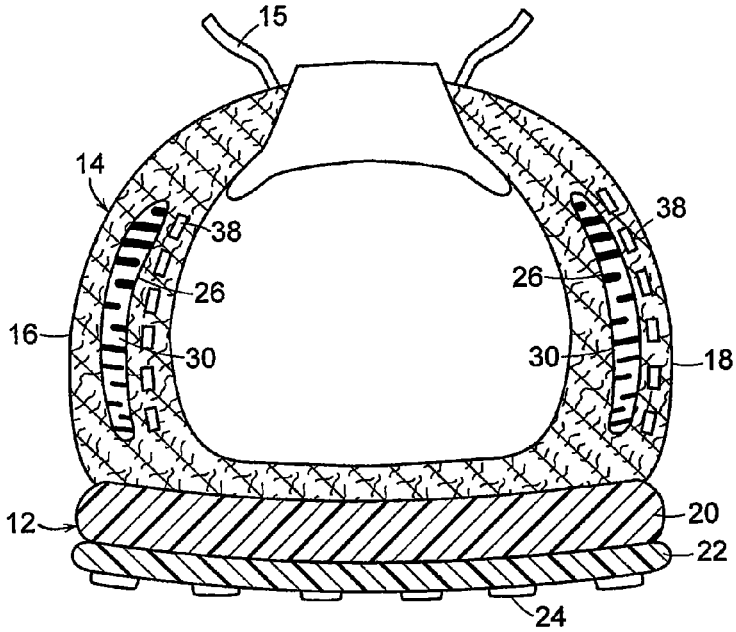
FIG. 3 is a section view of an alternative embodiment of an article of footwear with a variable support structure.

Another preferred embodiment is shown in FIG. 3, in which a plurality of permanent magnets 38 is positioned in sidewall 28. In the sidewall 28 on lateral side 18, magnets 38 are positioned outwardly of reservoir 26. In the sidewall 28 on medial side 16, on the other hand, magnets 38 are positioned inwardly of reservoir 26. It is to be appreciated that the magnets in either sidewall can be positioned outwardly or inwardly of reservoir 26. In both sidewalls 28, magnets 38 are positioned far enough away from reservoir 26 that in a first, inactive state, magnets 38 do not exert a magnetic field within reservoir 26 sufficient to transform magneto-rheological fluid 30 into a near-solid. Only when a user's foot moves toward sidewall 28 with sufficient force to cause magnets 38 and/or reservoir 26 to move does magneto-rheological fluid 30 transform into a near-solid. Thus, in this embodiment as well, the additional support structure of magneto-rheological fluid 30 in its near-solid state is provided on demand.

When the user's foot moves back toward its initial position, magnets 38 and reservoir 26 move away from one another such that magnets 38 no longer exert a magnetic field on reservoir 26, and magneto-rheological fluid 30 returns to its fluid state. As noted above with respect to FIGS. 1-2, this process of transforming magneto-rheological fluid 30 back and forth between its fluid and near-solid states happens very rapidly and, therefore, adapts to varying conditions on demand. The size of magnets 32, 38 depends on the size of reservoir 26 and, therefore, the amount of magneto-rheological fluid 30.

Figure 4:
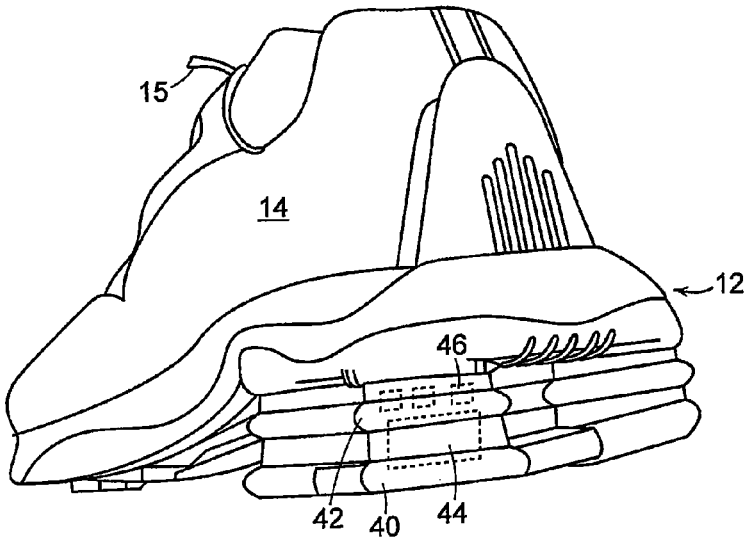
FIG. 4 is a perspective view of an alternative embodiment of an article of footwear with a variable support structure.

Another embodiment is shown in FIG. 4, in which a heel portion of sole structure 12 includes a plurality of compliant elastomeric support elements 40, which provide additional cushioning support for the user's heel. Support elements 40 may be hollow cylindrical columns, with one or more ridges or rings 42 circumscribing their exterior surface. Support elements 40 could include one or more circumscribing indentations, or one or more circumscribing indentations that include one or more rings. It is to be appreciated that support elements 40 may have other configurations including, for example, cubic, conic, pyramidal, or any other regular or irregular geometric shape.

A reservoir 44 containing magneto-rheological fluid is located within one or more of the support elements 40. A plurality of magnets 46 is positioned proximate each reservoir 44. Magnets 46 may be electromagnets that work with a load cell and a battery or other power source (not shown) as described above to create a magnetic field within reservoir 44. Alternatively, magnets 46 may be permanent magnets that, when moved close enough to reservoir 44, create a magnetic field within reservoir 44 as described above.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear having a variable support structure comprising, in combination:

a sole structure;

an upper secured to the sole structure;

at least one reservoir of magneto-rheological fluid in the upper; and a magnet assembly comprising a plurality of electromagnets proximate each reservoir; and a load cell configured to activate the electromagnets upon detection of a force from a user's foot and positioned in a sidewall of the upper;

wherein a magnetic field produced by the magnet assembly transforms the magneto-rheological fluid from a fluid state to a near-solid state.

2. The article of footwear of claim 1, further comprising a power source connected to the electromagnets.

3. The article of footwear of claim 2, wherein the power source comprises a battery.

4. The article of footwear of claim 1, wherein the reservoir of magneto-rheological fluid is located in a lateral sidewall of the upper.

5. The article of footwear of claim 1, wherein the reservoir of magneto-rheological fluid is located in a medial sidewall of the upper.

6. The article of footwear of claim 1, wherein the magnet assembly comprises a plurality of magnets on a first side of a reservoir and a plurality of magnets on an opposed second side of the reservoir.

7. The article of footwear of claim 1, wherein the magneto-rheological fluid comprises magnetic particles suspended in oil.

8. The article of footwear of claim 1, wherein the magneto-rheological fluid comprises iron molecules suspended in silicon.

9. An article of footwear having a variable support structure comprising, in combination:

a sole structure;

an upper secured to the sole structure;

a reservoir of magneto-rheological fluid in a sidewall of the upper;

a plurality of electromagnets in the sidewall; and a load cell configured to activate the electromagnets upon detection of a force from a user's foot and positioned in a sidewall of the upper;

wherein a magnetic field produced by the electromagnets transforms the magneto-rheological fluid from a fluid state to a near-solid state.

10. The article of footwear of claim 9, further comprising a power source connected to the electromagnets.

11. The article of footwear of claim 10, wherein the power source comprises a battery.

12. The article of footwear of claim 9, wherein the reservoir of magneto-rheological fluid is located in a lateral sidewall of the upper.

13. The article of footwear of claim 9, wherein the reservoir of magneto-rheological fluid is located in a medial sidewall of the upper.

14. The article of footwear of claim 9, wherein the electromagnets comprise a plurality of electromagnets on a first side of a reservoir and a plurality of electromagnets on an opposed second side of the reservoir.

15. The article of footwear of claim 9, wherein the magneto-rheological fluid comprises magnetic particles suspended in oil.

16. The article of footwear of claim 9, wherein the magneto-rheological fluid comprises iron molecules suspended in silicon.

17. An article of footwear having a variable support structure comprising, in combination:

a sole structure;

an upper secured to the sole structure;

a first reservoir of magneto-rheological fluid formed in a lateral sidewall of the upper;

a second reservoir of magneto-rheological fluid formed in a medial sidewall of the upper;

a first plurality of electromagnets positioned in the lateral sidewall;

a second plurality of electromagnets positioned in the medial sidewall; and a load cell configured to activate the electromagnets upon detection of a force from a user's foot and positioned in a sidewall of the upper;

wherein each plurality of electromagnets is configured to produce a magnetic field in a corresponding reservoir and transforms the magneto-rheological fluid from a fluid state to a near-solid state.

18. The article of footwear of claim 17, further comprising a power source connected to the electromagnets.

19. The article of footwear of claim 18, wherein the power source comprises a battery.

* * * * *